United States Patent [19]

Kikuchi et al.

[11] Patent Number: 5,039,238

[45] **Date of Patent: * Aug. 13, 1991**

[54] DOT-MATRIX PRINTER WITH IMPACT FORCE DETERMINATION

[75] Inventors: Hiroshi Kikuchi; Jiro Tanuma; Hideaki Ishimizu; Chihiro Komori, all of Tokyo, Japan

[73] Assignee: Oki Electric Industry Co., Ltd., Tokyo, Japan

[ * ] Notice: The portion of the term of this patent subsequent to Jul. 10, 2007 has been disclaimed.

[21] Appl. No.: 327,480

[22] Filed: Mar. 22, 1989

[30] Foreign Application Priority Data

Mar. 28, 1988 [JP] Japan ..... 63-73634
May 27, 1988 [JP] Japan ..... 63-130990

[51] Int. Cl.[5] ..... B41J 2/28; B41J 2/30

[52] U.S. Cl. ..... 400/124; 400/157.3; 101/93.03

[58] Field of Search ..... 400/124, 157.2, 157.3, 400/166; 101/93.03, 93.29

[56] References Cited

U.S. PATENT DOCUMENTS

| | | | |
|---|---|---|---|
| 4,192,230 | 3/1980 | Blom | 400/157.3 |
| 4,347,786 | 9/1982 | Sweat, Jr. et al. | 101/93.03 |
| 4,348,119 | 9/1982 | Carson | 400/157.2 |
| 4,740,094 | 4/1988 | Ueda | 400/157.3 |

FOREIGN PATENT DOCUMENTS

| | | | |
|---|---|---|---|
| 0117145 | 8/1984 | European Pat. Off. | 400/124 |
| 3112742 | 10/1982 | Fed. Rep. of Germany | 400/157.2 |
| 82684 | 6/1980 | Japan | 400/121 |
| 2864 | 1/1984 | Japan | 400/157.2 |
| 61-270163 | 11/1986 | Japan | 400/121 |
| 2008285 | 5/1979 | United Kingdom | 400/157.2 |

OTHER PUBLICATIONS

IBM Technical Disclosure Bulletin, vol. 29, No. 3, Aug. 1986, pp. 1412–1413.

*Primary Examiner*—David A. Wiecking
*Assistant Examiner*—Steven S. Kelley
*Attorney, Agent, or Firm*—Panitch Schwarze Jacobs & Nadel

[57] ABSTRACT

In a dot-matrix printer including a wire-dot print head having print wires which print dots by impact on a printing medium, and a sensor for sensing the position of the print wires and generating signals indicating the position of the print wires, a parameter is set to determine a printing force with which each of the print wires impacts the printing medium. A control and driving circuit drives the print wire responsive to the signals from the sensors and the set parameter. The combination of the feature of setting a parameter for controlling the printing force and the feature of detecting the position of the print wire enables the control over printing force with a high reproducibility. So printing with an optimum printing force is ensured.

9 Claims, 16 Drawing Sheets

PRIOR ART
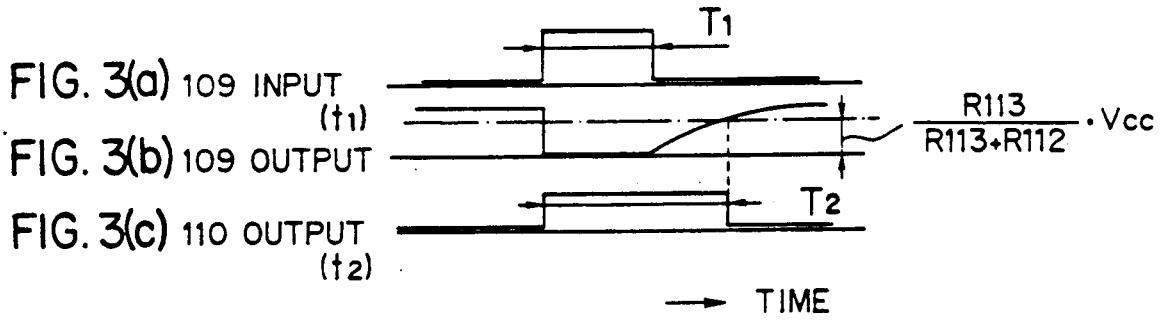
FIG. 4
PRIOR ART
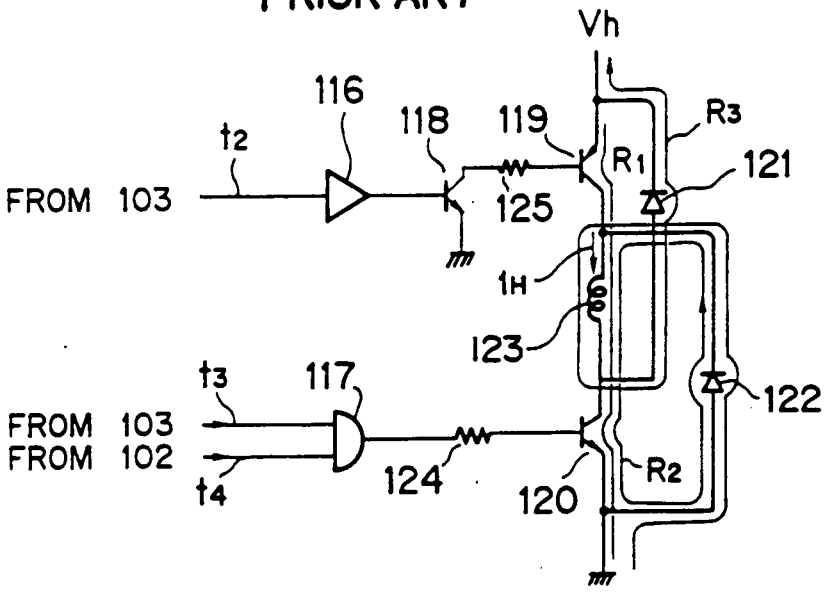

PRIOR ART
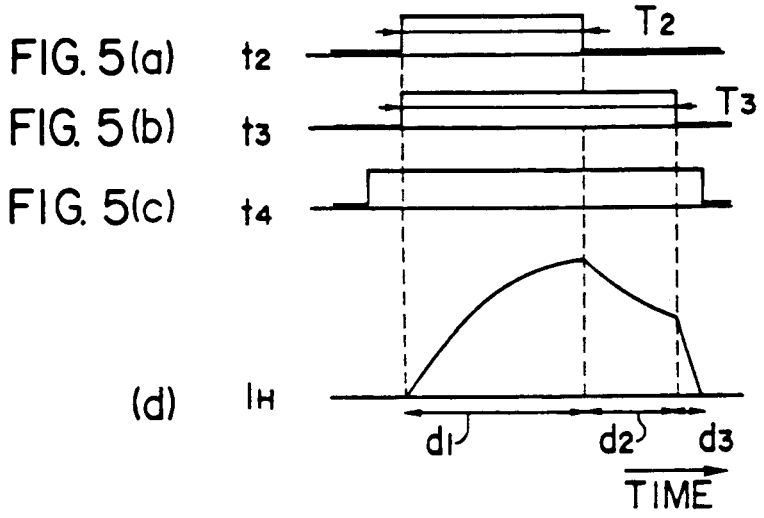
FIG. 6
PRIOR ART
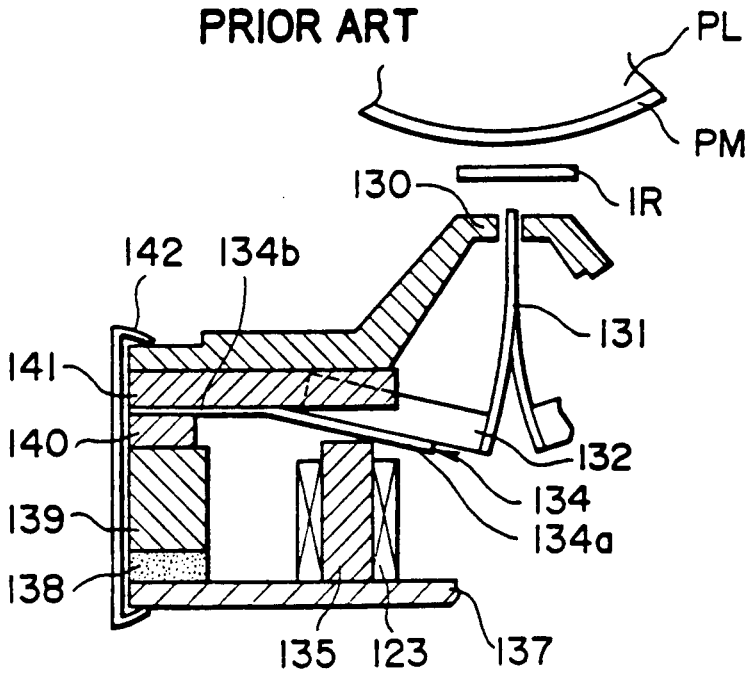

FIG.13 (a) OSC OUTPUT

TIME

DOT-MATRIX PRINTER WITH IMPACT FORCE DETERMINATION

BACKGROUND OF THE INVENTION

This invention relates to a dot-matrix impact printer for printing characters, symbols, and other information on media such as paper by means of wire dot impact.

Dot-matrix impact printers are widely used as output devices of information-processing apparatus such as personal computers. A prior-art dot-matrix impact printer is shown in block diagram form in FIG. 1. Data from the information-processing apparatus are received via an interface circuit 100 and applied to a central processing unit (hereinafter referred to as a CPU) 101 which controls the operation of the printer. The CPU 101 communicates with other parts of the printer via an integrated I/O circuit (an I/O circuit formed of a large-scale integrated circuit) 102 which transfers signals from the printer's control panel 106 to the CPU 101 and transfers signals from the CPU 101 to a timer circuit 103, a drive circuit 104, a line-feed motor 107, and a spacing motor 108. The drive circuit 104 drives wires in a wire-dot print head 105, causing the printing of characters or other information.

The control panel 106 comprises, for example, one or more pressure-sensitive membrane switches (not shown in the drawing) which, when pressed, generate electrical signals that are sent via the I/O circuit 102 to the CPU 101. The CPU 101 responds to these signals and to data received via the interface circuit 100 by controlling the timer circuit 103, the drive circuit 104, the line-feed motor 107, and the spacing motor 108 so that the desired information is printed by the wire-dot print head 105. The line-feed motor 107 moves the paper in the vertical direction and the spacing motor 108 moves the wire-dot print head 105 in the horizontal direction, enabling characters to be printed at different positions.

FIG. 2 is a schematic diagram showing an example of part of the timer circuit 103 in FIG. 1, associated with one print wire. As illustrated, it comprises an open-collector NOT gate 109, a comparator 110, resistors 111, 112, and 113, a diode 114, and a capacitor 115. This circuit receives an input timing signal $t_1$ from the I/O circuit 102 and generates an output timing signal $t_2$ which it sends to the drive circuit 104 in FIG. 1.

FIG. 3 is a timing chart illustrating the operation of the timer circuit in FIG. 2. The signal $t_1$ received from the I/O circuit 102, which is a pulse signal with a High duration of $T_1$ as shown in at (a) in FIG. 3, is inverted by the NOT gate 109, so when the signal $t_1$ goes High, the output signal of the NOT gate 109 goes Low, allowing the capacitor 115 to discharge to ground level. At the end of time $T_1$ the input of the NOT gate 109 goes Low again and its output returns to the High level (open state), causing the voltage Vh to charge the capacitor 115 through the resistor 111 with an RC time constant determined by the resistance (R111) of the resistor 111 and the capacitance (C115) of the capacitor 115. The output voltage of the NOT gate 109 rises as the capacitor 115 charges, as indicated in at (b) in FIG. 3. This rising voltage is received at the invert input terminal of the comparator 110. The comparator 110 receives at its non-invert input terminal a reference voltage determined by the resistance R112 of the resistor 112 and the resistance R113 of the resistor 113, according to the formula:

$$\text{Reference voltage} = R113 \cdot Vcc/(R112 + R113)$$

The output $t_2$ of the comparator 110 thus remains at the High level for the time $T_2$ until the charge in the capacitor 115 reaches the reference voltage level, as shown in at (c) in FIG. 3. The output signal $t_2$ thus generated by the timer circuit 103 is referred to as the Overdrive signal.

By circuits similar to the circuits 109 to 115, the timer circuit 103 also generates an output signal $t_3$ which goes High together with $t_1$ and remains High for a longer time $T_3$ (where $T_3 > T_2$). The signal $t_3$ is referred to as the Enable signal. Identical circuits generate separate Overdrive and Enable signals and send them to the drive circuit 104. The drive circuit 104 also receives Print signals $t_4$ from the I/O circuit 102.

A part of the drive circuit 104 associated with one print wire is shown in FIG. 4. As illustrated, it comprises a buffer amplifier 116, an AND gate 117, NPN transistors 118 and 120, a PNP transistor 119, diodes 121 and 122, and resistors 124 and 125, which are connected to a head coil 123 for driving an associated print wire. The Overdrive signal $t_2$ is received by the buffer amplifier 116, while the Enable signal $t_3$ and Print signal $t_4$ are received by the AND gate 117. The timing of these inputs is shown in FIG. 5. The Print signals select the wire to be driven. When the wire-dot print head 105 is at a given position on the paper, Print pulses are supplied only for the wires to be driven at that position.

When the illustrated part of the drive circuit 104 receives an Overdrive signal $t_2$, the NPN transistor 118 and the PNP transistor 119 both turn on. When the drive circuit 104 receives both an Enable signal $t_3$ and a Print signal $t_4$, the output of its AND gate 117 goes High, turning on the NPN transistor 120. A drive current $I_H$ is then permitted to flow from the power supply, which provides a voltage Vh, on a path marked $R_1$ in FIG. 4 through the PNP transistor 119, the head coil 123, and the NPN transistor 120 to ground. This current flows during the interval $d_1$ in at (d) in FIG. 5.

When the Overdrive signal $t_2$ goes Low, the NPN transistor 118 and the PNP transistor 119 both turn off, but the electromotive force generated by the head coil 123 causes a residual current to flow on the path marked $R_2$, circulating from the head coil 123 through the NPN transistor 120 and the diode 122, then back to the head coil 123. The current $I_H$ flowing through the head coil 123 therefore decreases gradually during the interval $d_2$ in at (d) in FIG. 5.

When the Enable signal $t_3$ goes Low, the output of the AND gate 117 also goes Low, turning off the NPN transistor 120 and changing the current path to the path marked $R_3$ in FIG. 4, from ground through the diode 122, the head coil 123, and the diode 121 to the power supply. The current $I_H$ flowing through the head coil 123 therefore rapidly decreases as indicated in the interval $d_3$ in at (d) in FIG. 5.

The way in which the current flowing through the head coil 123 drives the print wire will be explained next.

FIG. 6 shows a sectional view of the part of the wire-dot print head 105 for driving a print wire 131. For the purpose of explanation of the print head, the direction toward a printing paper PM in which the print wires are driven, i.e., the upward direction as seen in FIG. 6 is referred to the forward direction or front. The head coil 123 is wound around a core 135 to form an electromagnet. The core 135 is secured to a base plate or rear yoke 137, at the perimeter of which is fastened a permanent magnet 138. Mounted on the permanent magnet 138 in sequence from bottom to top in FIG. 6 are an upright support 139, a spacer 140, a plate spring 134, a front yoke 141, and a guide frame 130, the entire assembly being secured by an external clamp 142. An armature 132 is fastened to the inner free end of a radial part 134*a* of the plate spring 134, and the armature 132 is mounted on the plate spring 134. A print wire 131 is mounted to the armature 132. The tip of the print wire 131 extends through a central hole or a guide aperture in a guide frame 130 forward (upward in the drawing), i.e., toward the printing paper PM on the platen PL and out of the guide frame 130.

A magnetic flux circuit is formed from the permanent magnet 138, through the core 135, the armature 132, and the front yoke 141 back to the permanent magnet 138. When the head coil 123 is not energized, the flux generated by the permanent magnet 138 acts through the core 135 to attract the armature 132, thereby resiliently deforming the plate spring 134 as shown in FIG. 6, causing the print wire 131 to be kept retracting in the guide frame 130. When the head coil 123 is energized, it creates a flux in the core 135 that acts counter to the flux generated by the permanent magnet 138, thus weakening the attractive power of the core 135, allowing the plate spring 134 to recover by the force of its own resiliency and drive the print wire 131 upward in FIG. 6. The end of the print wire 131 then presses an ink ribbon IR against the printing paper PM on the platen PL to print a dot.

The print wires 131 in the wire-dot print head 105 are driven as selected by the Print signals as the wire-dot print head 105 moves back and forth and the paper moves in the feed-direction to print characters, symbols, and other information on the paper.

When the head coil 123 is de-energized, the flux from the permanent magnet 138 is reasserted in the core 135 and again attracts the armature 132 to the core 135, thus retracting the print wire 131.

The optimum energization time (drive time) of the head coil 123 varies depending on the printing conditions, including such factors as the time taken by the tip of the print wire 131 to reach the paper, the magnitude of the voltage Vh applied to the head coil 123, the number of print wires to be driven simultaneously, and the distance from the tip of the print wire to the paper (called the head gap). The pulse width $T_1$ of the signal $t_1$ is determined by the CPU 101 according to the number of wires to be driven simultaneously. As explained above, this time $T_1$ is extended in the timer circuit 103 to the time $T_2$, the amount of the extension being the time taken for the capacitor 115 to be charged through the resistor 111 by the voltage Vh, the extension thus being shorter when Vh is large and longer when Vh is small. The Overdrive signal $t_2$ is thus corrected not only for the number of print wires driven simultaneously, but also for variations in the voltage Vh applied to the head coil 123.

Although this system is capable of optimizing the drive time with respect to the two factors just mentioned, it does not enable the printing force (the force of impact of the print wires on the paper) to be varied freely in response to such factors as the thickness of the paper or the number of copies printed simultaneously. Yet different types of paper and types of printing have different optimum impact forces. Thin paper, for example, does not require a large impact force, and a small impact force is preferable in that it reduces the noise of the printing process.

If, however, the impact force is reduced by shortening the drive time of the head coil 123, the impact force may become unstable, degrading the quality of the printing. Due to unavoidable manufacturing variations in the wire-dot print heads, some print wires may fail to print at all.

Another problem is that if the impact force is adjusted to the optimum value for thin paper, when thick paper is used the impact force will be inadequate and the printing will be faint.

For this reason, in the prior art the impact force of the printer is adjusted for thick paper, causing a strong force to be employed even when it is not needed. This results not only in unnecessary noise, but also in unwanted indentations of the paper where the dots are printed.

SUMMARY OF THE INVENTION

It is accordingly an object of the present invention to provide a dot-matrix printer capable of printing with the optimum force according to the type of paper.

A dot-matrix printer according to this invention includes a wire-dot print head having print wires which print dots by impact on a printing medium, and a sensor for sensing the position of the print wires and generating signals indicating the position of the print wires. A parameter, such as the power supply voltage or a reference voltage used for determines the timing of the termination of the drive current, determining a printing force with which each of the print wires impacts the printing medium is set. A control and driving circuit drives the print wire responsive to the signals from the sensors and the set parameter. The combination of the feature of setting a parameter for controlling the printing force and the feature of detecting the position of the print wire enables the control over printing force with a high reproducibility. So printing with an optimum printing force is ensured.

BRIEF DESCRIPTION OF THE DRAWINGS

FIG. 3 is a timing chart illustrating the operation of the timer circuit in FIG. 2.

FIG. 4 is a schematic diagram of the drive circuit in FIG. 1.

FIG. 5 is a timing chart illustrating the operation of the drive circuit in FIG. 4.

FIG. 6 is a sectional view of the wire-dot print head in FIG. 1.

FIG. 13 illustrates signal waveforms at various points in FIG. 12.

DETAILED DESCRIPTION OF THE EMBODIMENTS

A novel dot-matrix impact printer according to the present invention will be described with reference to the drawings.

Figure 1:
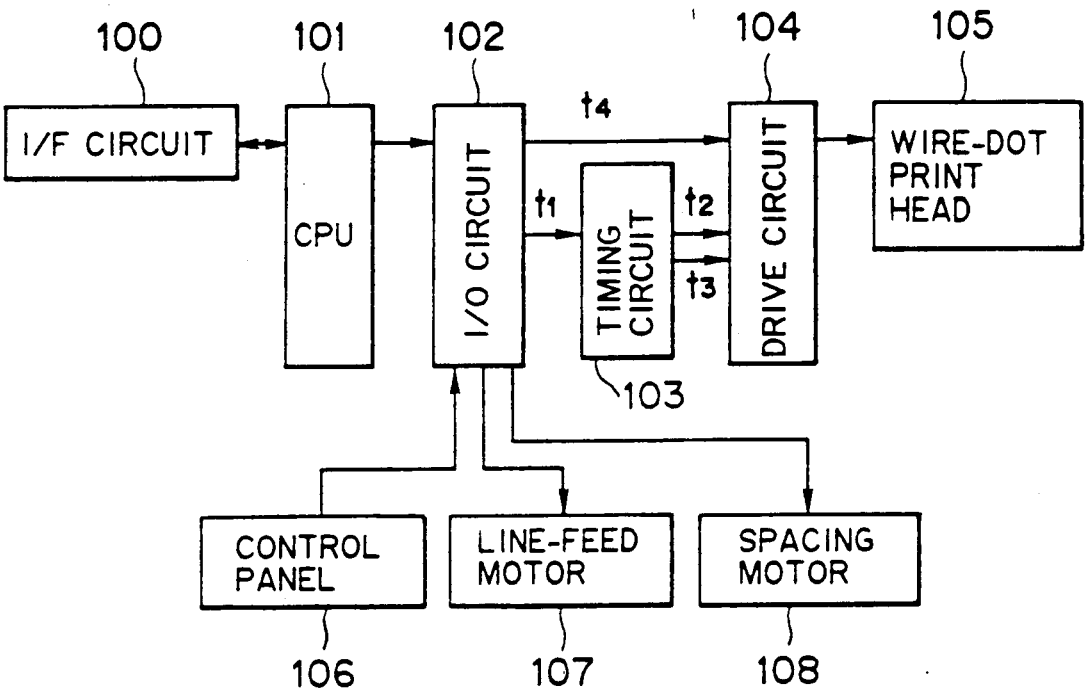
FIG. 1 PRIOR ART
FIG. 1 is a block diagram of a prior-art dot-matrix impact printer.
Figure 2:
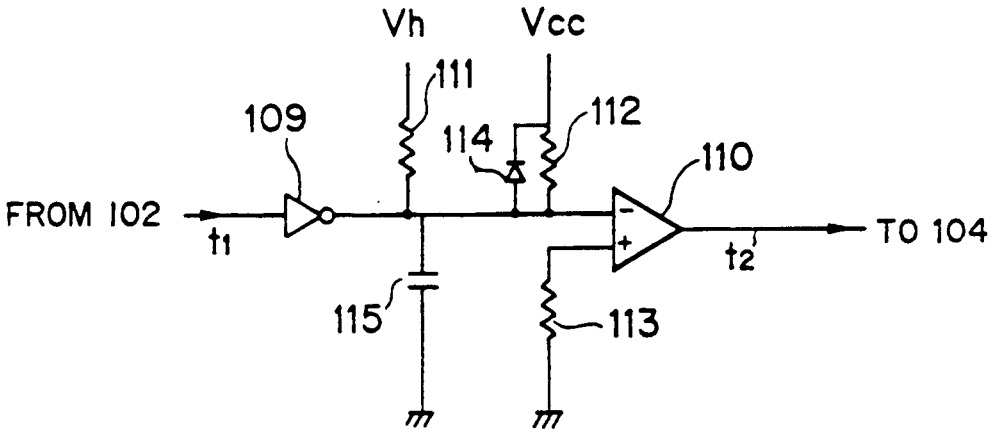
FIG. 2 PRIOR ART
FIG. 2 is a schematic diagram of the timer circuit in FIG. 1.
Figure 7:
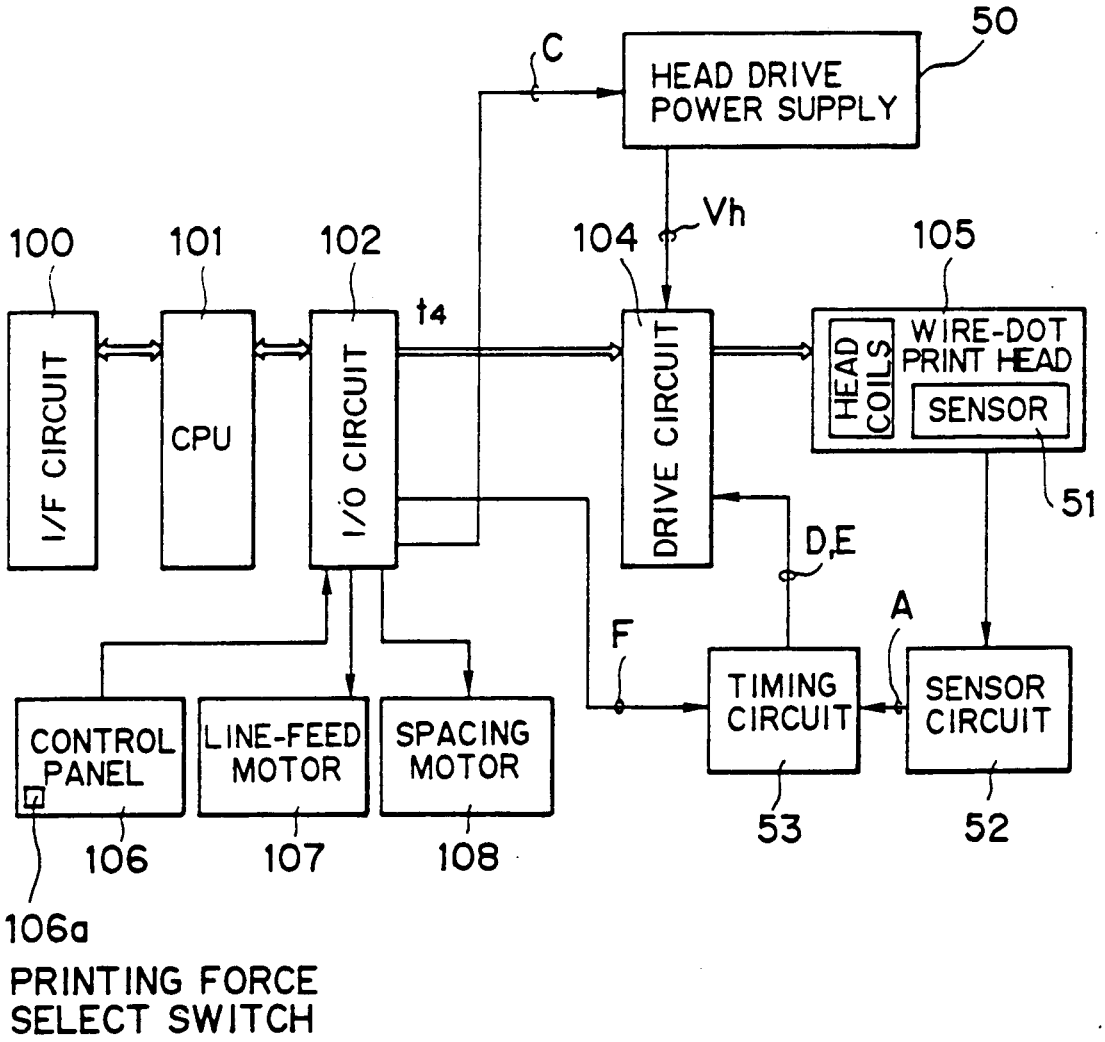
FIG. 7 is a block diagram of a dot-matrix impact printer of an embodiment of the present invention.

FIG. 7 is a block diagram of the novel dot-matrix impact printer. Blocks that correspond to blocks in FIG. 1 are indicated by the same reference numerals. (The same practice is followed in subsequent drawings.) The block labeled 50 is a power supply circuit which supplies necessary power to the wire-dot print head 105 via the drive circuits 104. The wire-dot print head 105 comprises, for each print wire, a sensor 51 which detects the displacement or position of the print wire. The output of the sensor 51 is provided to a sensor circuit 52 which generates a signal A corresponding to the position of the print wire. The signal A is sent to a timing circuit 53 which generates necessary timing signals, which it supplies to the drive circuit 104. The sensor 51, the sensor circuit 52, and the timing circuit 53 replace the timer circuit 103 in the prior art.

The control panel 106 is provided with a printing force selection switch **106*a*** which is manipulated for changing the power supply voltage Vh.

The CPU 101 detects the manipulation of the selection switch **106*a* through the I/O circuit 102, and determines the selected power supply voltage Vh, and supplies a voltage designation signal H to the head drive power supply 50. The head drive power supply 50 is capable of selectively producing a voltage which can be varied stepwise. That is, the power supply 50** is capable of producing either a 35 V voltage for strong printing force or a 17 V voltage for weak printing force.

The other blocks in FIG. 7 are identical to the corresponding blocks in the prior art.

Figure 8:
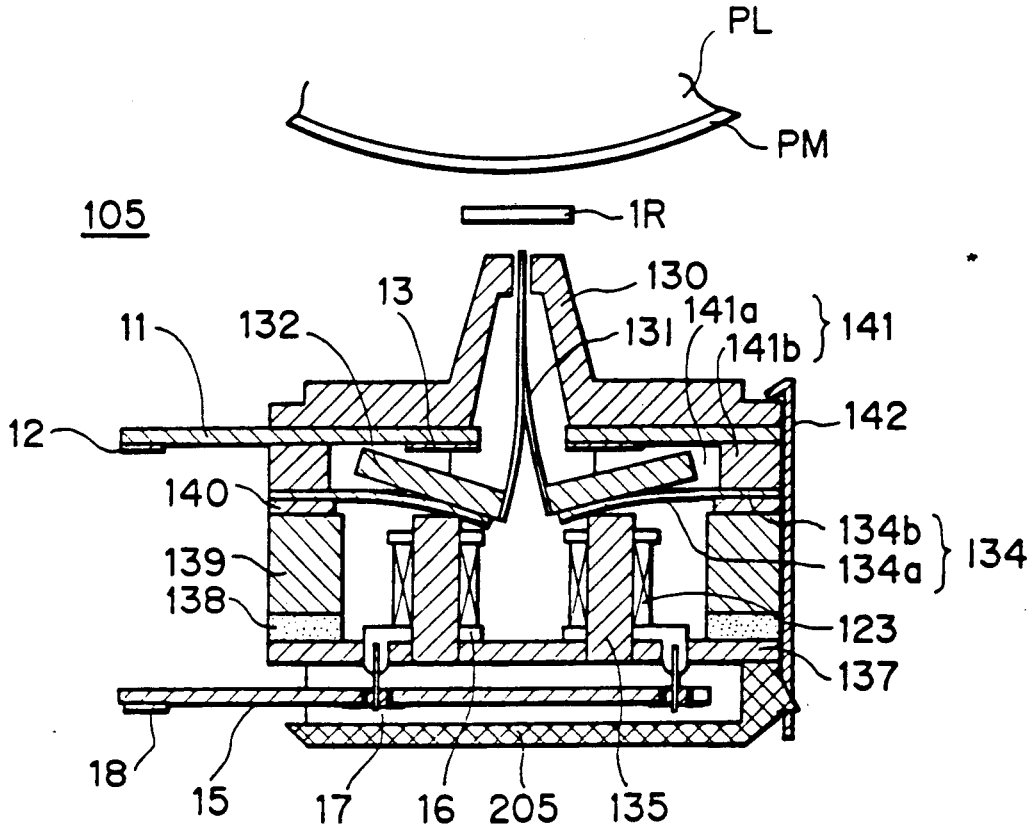
FIG. 8 is a sectional view of the print head of a dot-matrix impact printer according to the present invention.

FIG. 8 shows a sectional view of an embodiment of the wire-dot print head 105, which is generally cylindrical. The print head 105 has a generally disk-shaped cover 205 at the rear end (bottom as seen in FIG. 8) and a guide frame 130 at the front end (top as seen in FIG. 8). The guide frame 130 of this embodiment is formed of an electrically insulating material such as a plastic resin and has central guide apertures through which the print wires 131 protrude for impact on a print medium such as a print paper on a platen, not shown. The print wires 131 extend forward generally parallel with each other. For the purpose of explanation, "front" or "forward" refers to the direction toward which the print wires are moved for impact on the paper, i.e., upward as seen in FIG. 8.

Between the cover 205 and the guide frame 130 are mounted, in sequence from rear side (bottom in FIG. 8) to the front side (top in FIG. 8), a generally disk-shaped base plate or rear yoke 137 of a magnetically permeable material, an annular permanent magnet 138, an annular upright support 139, an annular spacer 140, a plate spring 134 having an annular part **134*b* and radial parts 134*a* extending from the annular part 134*b* radially inward, and a front yoke 141 having an annular part 141*b* and radial parts 141*a* extending from the annular part 141*b* radially inward so that they are positioned between adjacent radial parts 134*a* of the plate spring 134. The permanent magnet 140, the upright support 139, the spacer 140, the annular part 134*b* of the plate spring 134 and the annular part 141*b* of the front yoke 141 have generally the same outer and inner peripheries and form a cylindrical wall for the print head 105. All these components are held together by an external clamp 142**.

The annular part **134*b* of the plate spring 134 is clamped between the annular part 141*b* of the front yoke 141 and the spacer 140. Elongated armatures 132 extend in radial directions and attached to the respective radial parts 134*a* of the plate spring 134. Thus each radial part 134*a* of the plate spring 134 acts as a resilient support member for the associated armature 132. Because the radial part 134*a* act independently as individual springs, each of the radial parts 141*a* of the plate spring 141 is also called a plate spring. Each armature 132 is positioned between adjacent radial parts 141*a* of the front yoke 141. Conversely stated, there is one radial part 141*a* of the front yoke 141 between adjacent armatures 132. The side surfaces of the armatures 132 and the side surfaces of the radial parts 134*a* are in close proximity with each other. The armatures 132 are provided in association with the respective print wires 131. A rear end of each print wire 131 is fixed to the inner end of the associated armature 132**.

Cores 135 are provided in association with the respective armatures 132. Each core 135 has its forward end adjacent to rear surface of the associated armature 132. The cores 135 are mounted on the rear yoke at their rear ends. Bobbins 16 are provided to surround the respective cores 135 and are also mounted on the rear yoke 137. Coils 123 are provided in association with the respective cores 135. Each coil 123 is wound on the bobbin 16 for the associated core 135, to form an electromagnet, which is electrically coupled via a coil terminal 17 to a printed circuit card 15 disposed beneath the rear yoke 137, between the rear yoke 137 and the cover 205. The printed circuit card 15 is fitted in a card-edge connector (not shown in the drawing) having a terminals corresponding to the terminals 18. The printed circuit card 15 is provided with copper foil wiring, formed by patterning, for connecting respective coil terminals 17 and input terminals. The input terminals are electrically coupled to the drive circuit 104 in FIG. 7.

The rear yoke 137, the cores 135, the armatures 132, the front yoke 141, the annular part **134*b* of the plate spring 134, the spacer 140, and the upright support 139** forms a magnetic path for the magnetic flux from the permanent magnet 138. Because of this magnetic flux the armatures 132 are attracted to the cores 135.

As will be described in further detail later, an electric current is made to flow through the coils 123 for generating a magnetic flux through the core 135 in a direction to cancel the magnetic flux through the core 135 from the permanent magnet 138. When each of the coils 123 is not energized the associated armature 132 is attracted toward the associated core 135 to resiliently deform the associated resilient support member 134*a*. When each of the coils 123 is energized the associated armature 132 is released and moved forward by the action of the associated resilient support member 134*a*.

A sensor card 11 in the form of a printed circuit board is positioned in front of the front yoke 11, between the front yoke 141 and the guide frame 130. Sensor electrodes 13 are formed on the sensor card 11, and are created by patterning. The sensor electrodes 13 are in association with the respective armatures 132 and confront the front surfaces of the associated armatures 132 when the latter are moved forward, for printing. The armature 132 and the sensor electrode 13 form a pair of opposing plates with an air gap between them, thus acting as an air-gap capacitor with a static capacitance that depends on the width of the gap, hence on the position of the armature 132. It is this capacitor that is denoted as the capacitive sensor 51 in FIG. 7. The motion of the print wire 131 attached to the armature 132 can be detected by sensing the capacitance change of this capacitive sensor 51.

The radial parts 141*a* of the front yoke 141 are on both sides of each armature 132 so that they effectively shield the sensor electrode 13 to avoid interference between adjacent sensor electrodes 13.

Figure 9:
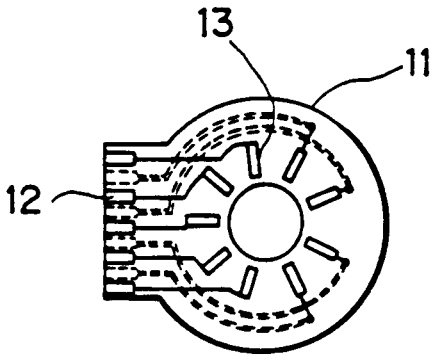
FIG. 9 is a plan view of the sensor card in the print head in FIG. 8.

FIG. 9 shows a plan view of the sensor card 11. In this example the head is shown to have nine print wires 131, hence nine armatures 132 and nine sensor electrodes 13. An independent connecting line leads from each sensor electrode 13 to terminals 12. By insertion of the sensor card 11 into a card-edge connector (not shown) having terminals corresponding to the terminals 12, the terminals 12 are connected via the terminals of the card-edge connector to the sensor circuit 52 in FIG. 7. In the illustrated example, some connecting lines run on the same side of the sensor card 11 as the sensor electrodes 13, while others run on the opposite side and connected to the sensor electrodes 13 via through holes. The sensor electrodes 13, and the connecting lines as well as the rest of the sensor card 11 are coated with an insulating film, such as a photoresist applied over the entire surface of the sensor card. This coating insulates the electrodes and the connecting lines from the front yoke and provides protection against damages in case of collision during assembly or during operation of the print head. The armatures 132 are electrically coupled via the plate spring radial parts 134*a* to a common ground terminal, which is connected to the sensor circuit 52 as well as other circuits. The plate spring 134 is formed of a conductive material and joined at the circumference of the head.

Figure 10:
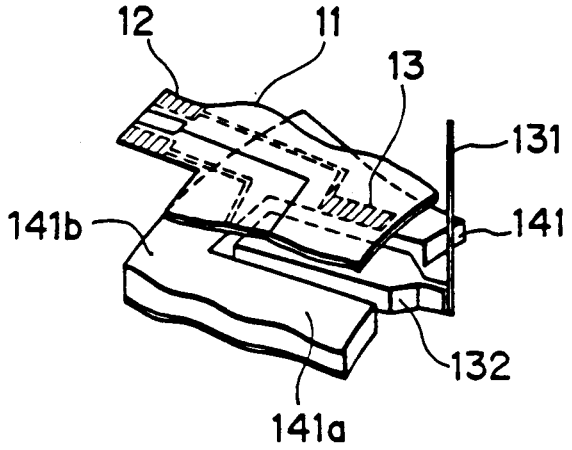
FIG. 10 is an oblique view illustrating the armature and sensor electrode in FIG. 8.

FIG. 10 is an oblique view showing how an armature 132 is mounted in relation to the front yoke 141, how it drives the print wire 131, its relation to the sensor electrode 13, and the connection of the sensor electrode 13 to the output terminal 12. For clarity, the sensor card 15 is shown slightly separated from the front yoke 141, but when the wire-dot print head 105 is assembled, the sensor card 11 and the front surface of the front yoke 141 are actually in contact. The print wire 131 is attached to the end of the armature 132, which faces the sensor electrode 13. Since the sensor electrode 13 and the armature 132 are separated by a gap, they form a static capacitance, which acts as the sensor 51 in FIG. 7 by detecting the position of the print wire 131. More specifically, when the gap between the armature 132 and the sensor electrode 13 is large, the static capacitance between them is small, and when the gap is small, the static capacitance is large. The position of the print wire 131 can thus be detected as a variation in the static capacitance of the sensor 51.

It is not necessary for the part facing the sensor electrode 13 to be the armature 132. Another component that is attached to the armature and moves together with the print wire 131 can be used instead.

Figure 11:
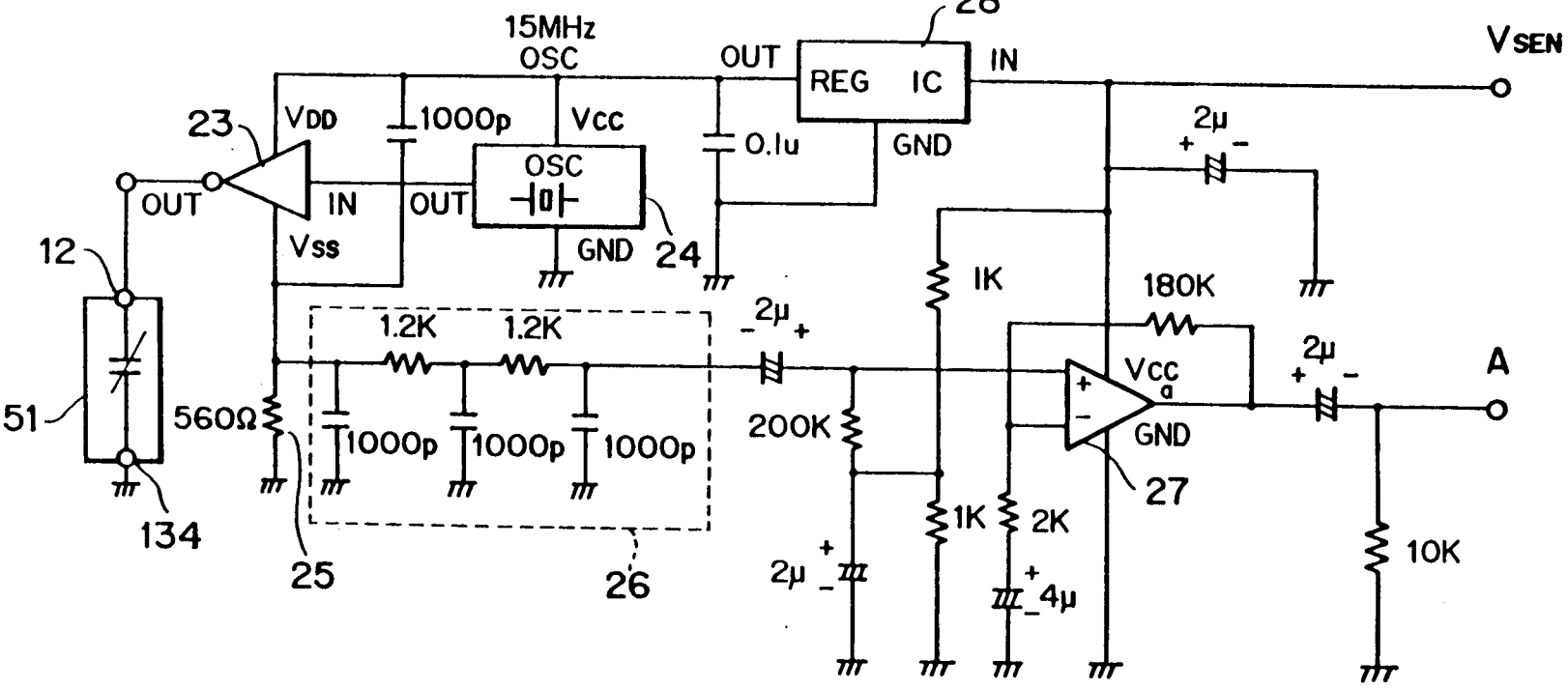
FIG. 11 is a block diagram of an embodiment of the sensor circuit.

FIG. 11 is a diagram of the sensor circuit 52 that receives the output from the sensor 51 and generates an output signal A indicating the position of the print wire 131. The sensor circuit 52 comprises a digital IC 23 such as the MSM74HCU04 manufactured by Oki Electric Industry Co. LTd., the output terminal of which is connected to the output terminal 12 on the sensor card 11. The sensor 51 is also connected to the sensor electrode 134, which functions as its common ground return. The sensor circuit 52 also comprises an oscillator 24 with a frequency f (Hz), a resistor 25 with a resistance Rs, a differentiator 26 comprising resistors and capacitors, an amplifier 27 having a gain Ga (such as the uPC258 manufactured by Nippon Denki Kabushiki Kaisha), and a regulator IC 28 (such as the 7805 manufactured by Nippon Denki Kabushiki Kaisha) that generates a regulated DC current. Additional resistors and capacitors are included in the circuit as shown in the drawing.

Figure 12:
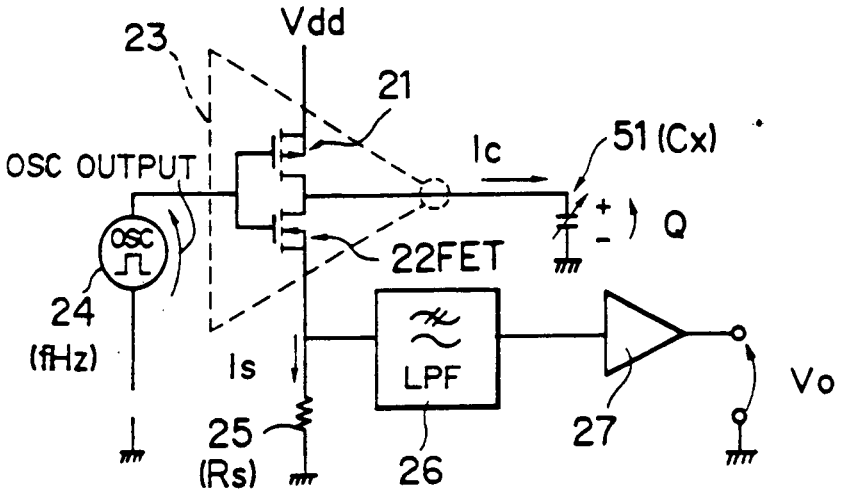
FIG. 12 illustrates the principle of operation of the sensor circuit.

The sensor circuit 52 in FIG. 11 can be depicted in a simplified form as shown in FIG. 12. The digital IC 23 is shown as comprising two MOS field-effect transistors 21 and 22 (hereinafter referred to as FETs) connected in series between the voltage $V_{DD}$ and the resistor 25.

When the digital IC 23 receives a square-wave signal from the oscillator 24 as shown in at (a) in FIG. 13, the FETs 21 and 22 switch on and off alternately. When the FET 21 is on, the voltage $V_{DD}$ charges the capacitance of the sensor 51 through the FET 21. When the FET 22 is on, the charge stored in the sensor 51 discharges through the FET 22 and the resistor 25. The digital IC 23 therefore generates a current $i_c$ having the waveform indicated in at (b) in FIG. 13, obtained by differentiating the signal in at (a). Since the current $i_s$ flowing through the resistor 25 is a discharge current, it has a waveform like that shown in at (c) in FIG. 13. If a charge Q is stored in the sensor 51, the integral of the $i_s$ curve for one cycle will be substantially equal to Q. If the static capacitance of the sensor 51 is $C_x$, then the average value $I_s$ of the current $i_s$ is:

$$I_s = f \cdot Q = f \cdot C_x \cdot V_{DD}$$

Thus when the voltage at the terminal of the resistor 25 is obtained by the differentiator 26 and the amplifier 27, the output voltage $V_O$ of the amplifier 27 is:

$$V_O = C_x \cdot Rs \cdot a \cdot f \cdot V_{DD}$$

This equation indicates that the voltage $V_O$ is proportional to the capacitance $C_x$ of the sensor 51.

Normally an AC amplifier is used as the amplifier 27, and its output contains, in addition to the component due to the capacitance of the sensor 51, a DC offset component caused by, for example, distributed capacitance effects. The offset component is removed to leave the component representing the position of the print wire 131.

Figure 14:
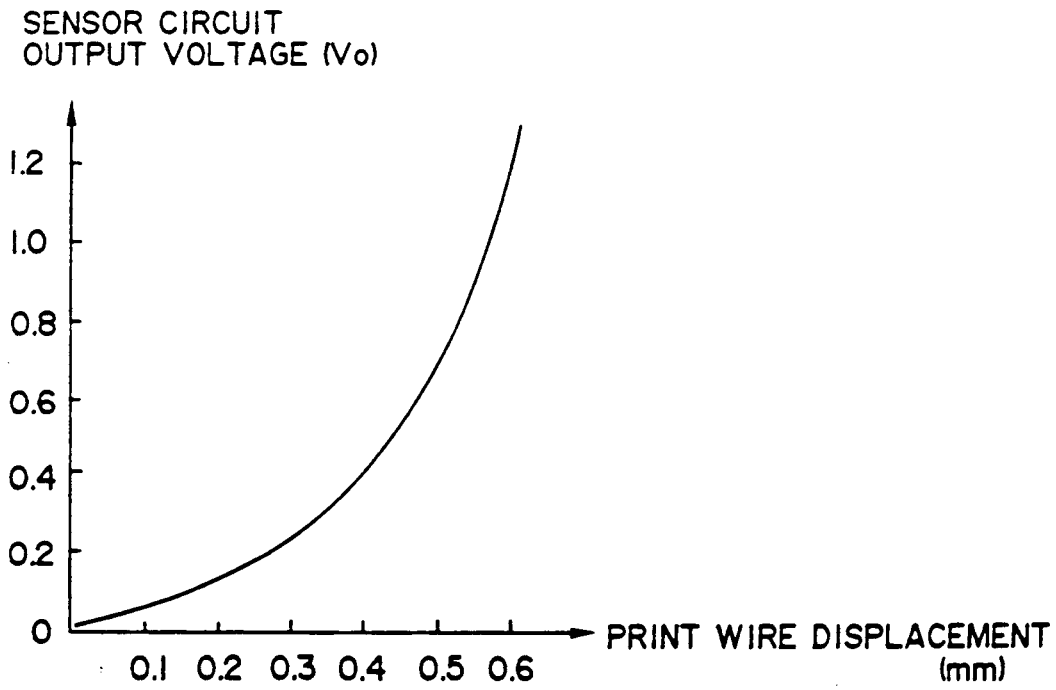
FIG. 14 is a graph of the position vs. output voltage characteristic of the sensor circuit.

The capacitance $C_x$ of the sensor 51 is substantially inversely-proportional to the distance between the armature 132 and the sensor electrode 13. The output voltage $V_O$ of the sensor circuit 52 therefore varies with respect to the position of the print wire 131 as shown in FIG. 14.

Figure 15:
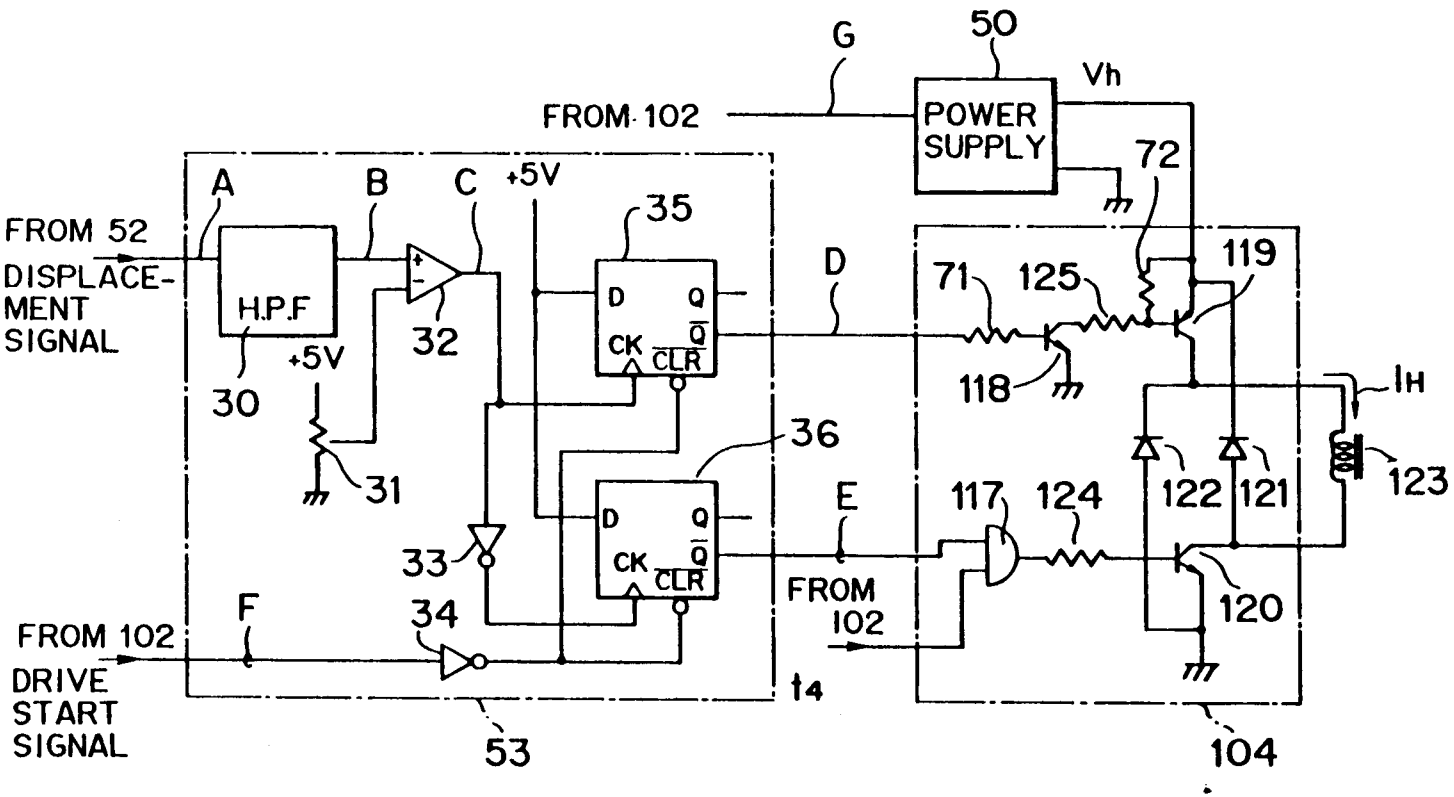
FIG. 15 is a schematic diagram of the timing and drive circuits.

FIG. 15 shows a detailed view of the timing circuit 53 and the drive circuit 104. The timing circuit 53 comprises a differentiator 30 (a high-pass filter) that differentiates the position signal (the voltage $V_O$) output by the sensor circuit 52, a comparator 32 that compares the output of the differentiator 30 with a reference voltage obtained from a variable resistor 31, NOT gates 33 and 34 which receive input signals and generate their inverted output, and delay flip-flop circuits 35 and 36 (D flip-flops) which receive signals with a certain High level (of +5 V) at their data (D) terminals. The drive circuit 104 comprises, in addition to the components shown in FIG. 4, resistors 71 and 72, but is basically similar to the circuit in FIG. 4.

Figure 16:
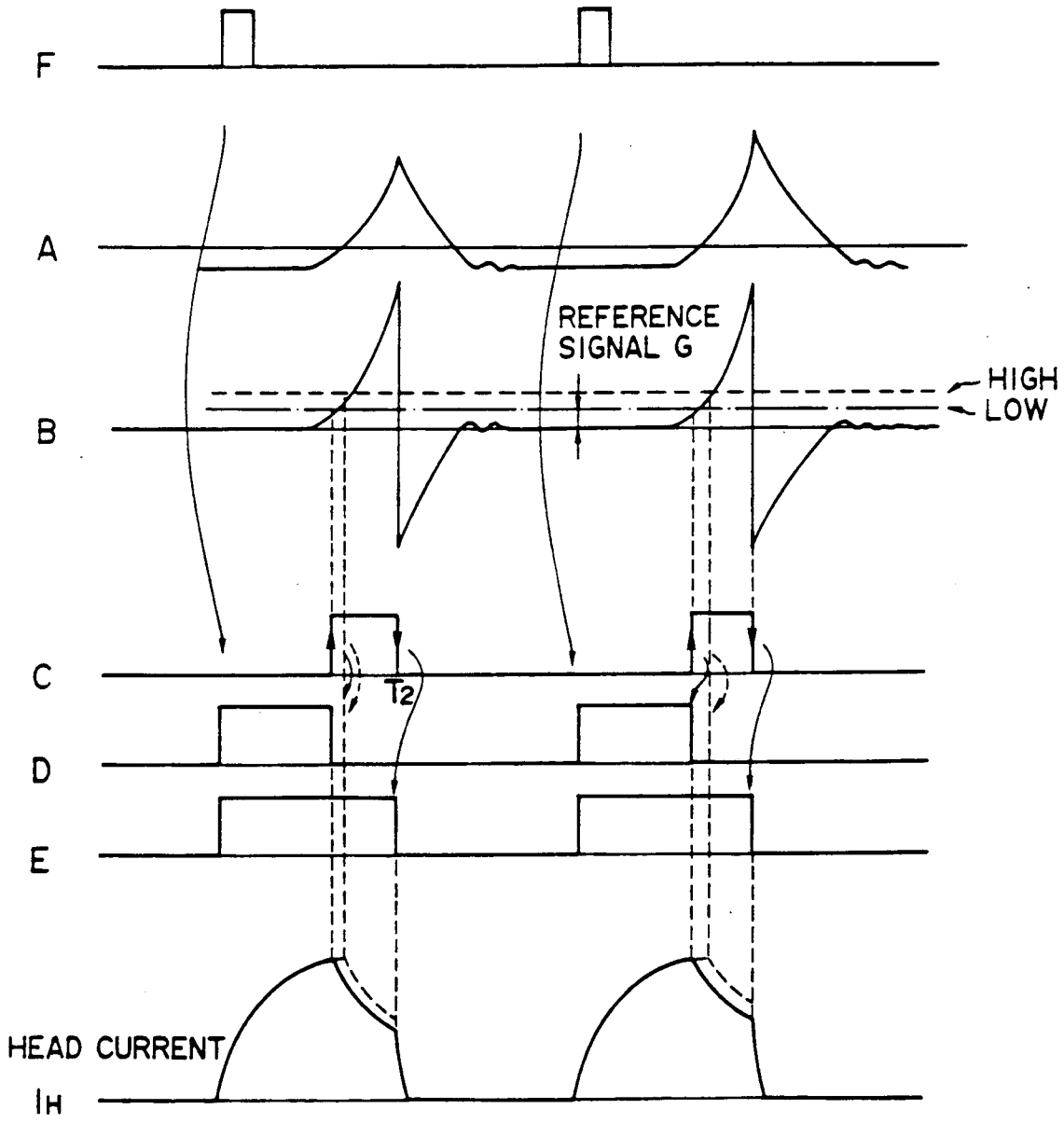
FIG. 16 illustrates signal waveforms at various points in FIG. 15.

The operation of the circuit in FIG. 15 will be described with reference to FIG. 16. The drive start signal output from the integrated I/O circuit 102, shown in at (a) in FIG. 16, is inverted by the NOT gate 34, then supplied to the Clear ($\overline{CLR}$) terminals of the D flip-flops 35 and 36, thus resetting these flip-flops. The signals (D and E) at the $\overline{Q}$ output terminals of the D flip-flops 35 and 36 therefore go High as shown in lines (e) and (f) in FIG. 16.

When the output signal at the $\overline{Q}$ output terminal of the D flip-flop 35 (which corresponds to the Overdrive signal in the prior art) goes High, the NPN transistor 118 and the PNP transistor 119 both switch on. The AND gate 117 receives at one of its inputs a Print signal $t_4$ from the integrated I/O circuit 102, so when the output signal (E) from the D flip-flop 36 (which corresponds to the Enable signal in the prior art) goes High, the AND gate 117 generates a High output signal that switches on the NPN transistor 120. As a result, a head current $I_H$ flows through the PNP transistor 119, the head coil 123, and the NPN transistor 120 to ground, as indicated in at (g) in FIG. 16.

This results in a decrease in the magnetic flux in the sensor electrode 135, allowing the sensor electrode 134 to move forward (upward in FIG. 7) under its own resilient force. The armature 132 fastened to the sensor electrode 134 thus also moves forward, and with it the print wire 131 attached to the armature 132.

When the armature 132 moves forward, the gap between it and the sensor electrode 13 is reduced by an amount corresponding to the position of the print wire 131, causing the output signal A (the position signal) generated by the sensor circuit 52 to gradually increase, reaching a peak when the print wire 131 impacts the paper as shown in the drawing. After the impact, the print wire 131 moves away from the paper and back in the rearward (downward direction in FIG. 7), causing the output A of the sensor circuit 52 to gradually decrease as shown in at (b) in FIG. 16.

The position signal A generated by the sensor circuit 52 is supplied to the differentiator 30, which differentiates it. The output B of the differentiator 30 (the velocity signal) gradually increases in the positive direction as shown in at (c) in FIG. 16, reaches a positive peak at the instant of impact, jumps down to a negative peak when backward motion begins, then gradually recovers to zero. The reference voltage is adjusted to detect onset of forward motion of the print wire 131. The output signal B of the differentiator 30 thus increases during the interval from when the print wire 131 starts to move forward until it impacts the paper and starts to move backward. It is during this interval that the output C of the differentiator 30 is High, as indicated in at (d) in FIG. 16.

Once the print wire 131 begins moving forward, it continues to move forward under the resilient force of the sensor electrode 134, so it is unnecessary to supply further current to the head coil 123. For this reason the Clock (CK) terminal of the D flip-flop 35 receives the output C of the differentiator 30, the leading edge of which causes the D flip-flop 35 to invert, as shown in at (e) in FIG. 16, switching the PNP transistor 119 off. A residual current (the current $R_2$ described in the prior art) now circulates through the diode 122, the head coil 123, and the NPN transistor 120.

After the print wire 131 impacts the paper, the head coil 123 no longer requires the residual current, so the output of the comparator 32 is inverted by the NOT gate 33 and supplied to the Clock input terminal of the D flip-flop 36. The output E of the D flip-flop 36 thus inverts at the moment of impact of the print wire 131 (on the trailing edge of the output of the comparator 32), as shown in at (f) in FIG. 16, turning off the NPN transistor 120. The residual current flow is then quickly absorbed on the path from ground to the diode 122, the head coil 123, and the diode 121, to the power supply circuit 50, as indicated in at (g) in FIG. 16.

When the current flowing through the head coil 123 is reduced, the flux of the sensor electrode 138 attracts the armature 132 to the sensor electrode 135 again.

The drive time of the print wire 131 is thus controlled in a closed-loop fashion according to the actual motion of the print wire, enabling sufficient energy to be supplied to the wire-dot print head 105 regardless of variations in the paper thickness and other factors. The printing process can thus be carried out efficiently with optimal timing. Moreover, printing force can be varied, with a high reproducibility, by variation of the power supply voltage Vh as will be later described in further detail.

Figure 7A:
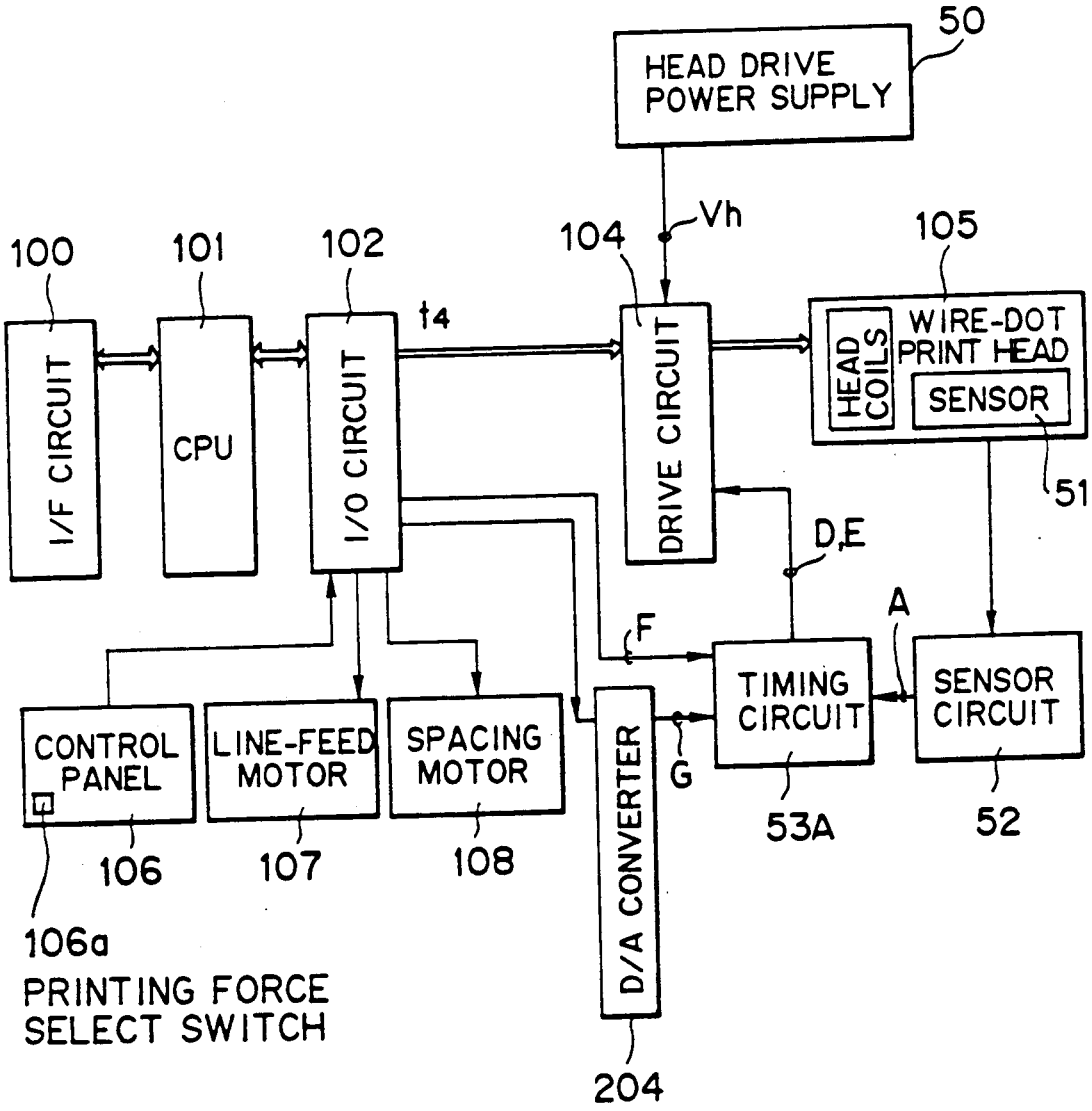
FIG. 7A is a block diagram of a dot-matrix impact printer of another embodiment of the present invention.
Figure 15A:
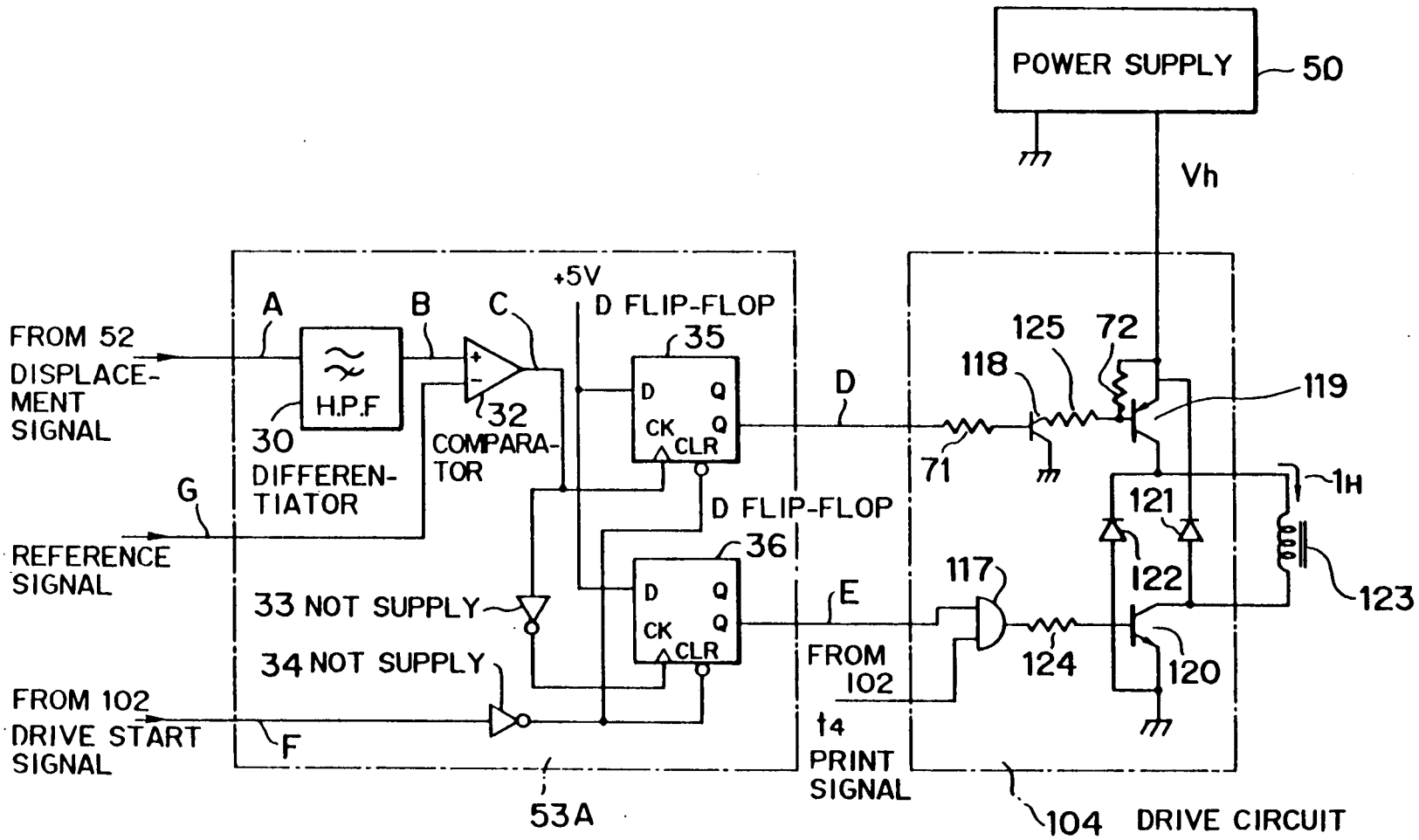
FIG. 15A is a schematic diagram of the timing and drive circuits of the embodiment of FIG. 7A.

FIG. 7A shows a second embodiment of the invention. In this second embodiment, the CPU detects the manipulation of the control panel 106 and determines the selected reference voltage, and supplies a D/A converter 204, through the I/O circuit 102, with a digital signal Ga designating the reference voltage G, and the D/A converter 204 produces an analog voltage reference signal G and sends it to a timing circuit 53A whose details are shown in FIG. 15A, and which is similar to, but a little different from the timing circuit 53 shown in FIG. 15. That is, as illustrated in FIG. 15A, the reference voltage G to the comparator 32 is supplied from the D/C converter 204. The power supply circuit 50 of this embodiment can be of such a construction as to produce a fixed voltage of say 35 V.

Changing the reference voltage G causes changing the timing T1 (FIG. 16) at which the transistor 119 (FIG. 15A) is turned off. This has the effect of varying the printing force.

Figure 17:
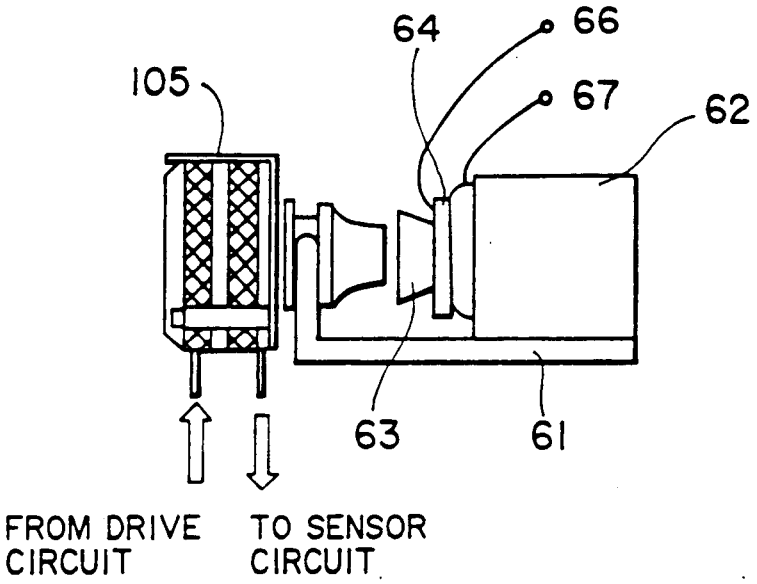
FIG. 17 is a sectional view of a device for measuring impact force.
Figure 18:
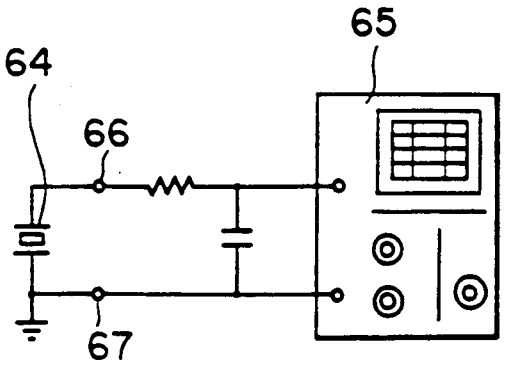
FIG. 18 is a wiring diagram illustrating the connections of the device in FIG. 17.
Figure 19:
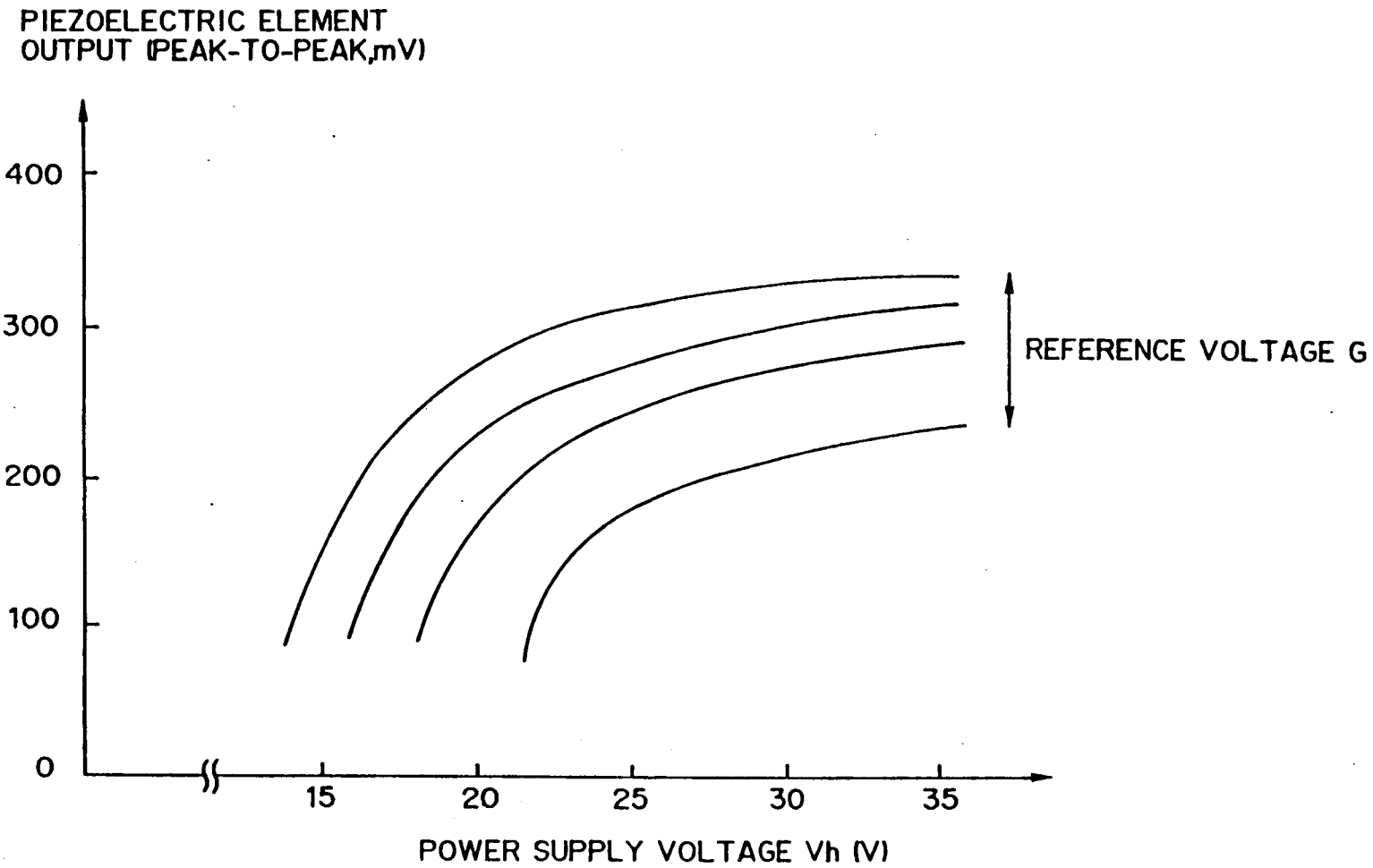
FIG. 19 is a graph illustrating the printing voltage vs. impact force characteristic of a dot-matrix impact printer according to this invention.

The change in printing force resulting from changes in the voltage Vh applied to the head coil 123 in a wire-dot. print head 105 of the above structure and from changes in the reference voltage G was measured with the measurement apparatus shown in FIG. 17, comprising a test mount 61 with a block 62 fixed at one end, a piezoelectric element 64 attached to the block 62, and a super-hard metal alloy target 63 mounted on the piezoelectric element 64. The wire-dot print head 105 was mounted at the other end of the test mount 61 in such a position that its print wires would impact the super-hard metal alloy target 63. The output terminals 66 and 67 of the piezoelectric element 64 were connected to an oscilloscope through a low-pass filter comprising a resistor and a capacitor as shown in FIG. 18, and the peak-to-peak output values (indicating printing force) of the piezoelectric element 64 were observed. FIG. 19 shows the results.

As shown in FIG. 19, when the voltage Vh supplied to the head coil 123 was in the range of 25 to 35 V, the printing force is substantially unchanged. In this region, the printing force varies with the reference voltage G, with the variation being greater with the greater reference voltage G.

The relationship between the printing force and the applied voltage when the reference voltage G is fixed was as follows.

Figure 20:
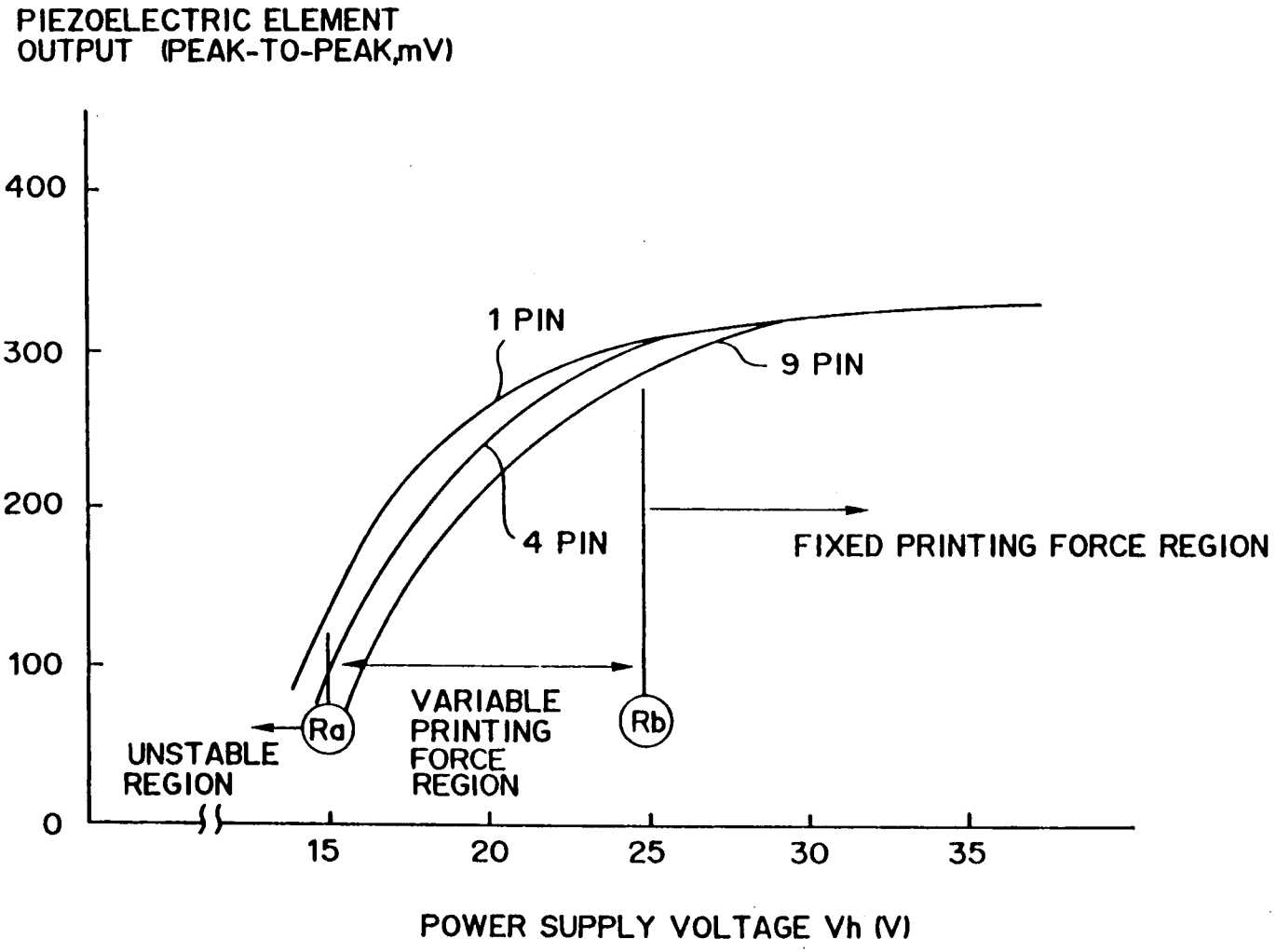
FIG. 20 is a graph illustrating the printing voltage vs. piezoelectric element output characteristic of a dot-matrix impact printer according to this invention.

As shown in FIG. 20, when the voltage Vh supplied to the head coil 123 was less than about 15 V (to the left of the line marked Ra in the drawing), printing became unstable: the print wire 131 did not consistently impact the super-hard metal alloy target 63, and the output of the piezoelectric element 64 decreased sharply. When the voltage Vh was greater than about 25 V (to the right of the line Rb in the drawing), the output of the piezoelectric element 64 remained substantially constant near its maximum value. In the interval between about 15 V and about 25 V (between the lines Ra and Rb in FIG. 20), the output of the piezoelectric element 64 changed gradually in response to the changing voltage Vh. In this interval it is therefore possible to modify the printing force in a stable manner by appropriate adjustment of the voltage Vh.

Figure 21:
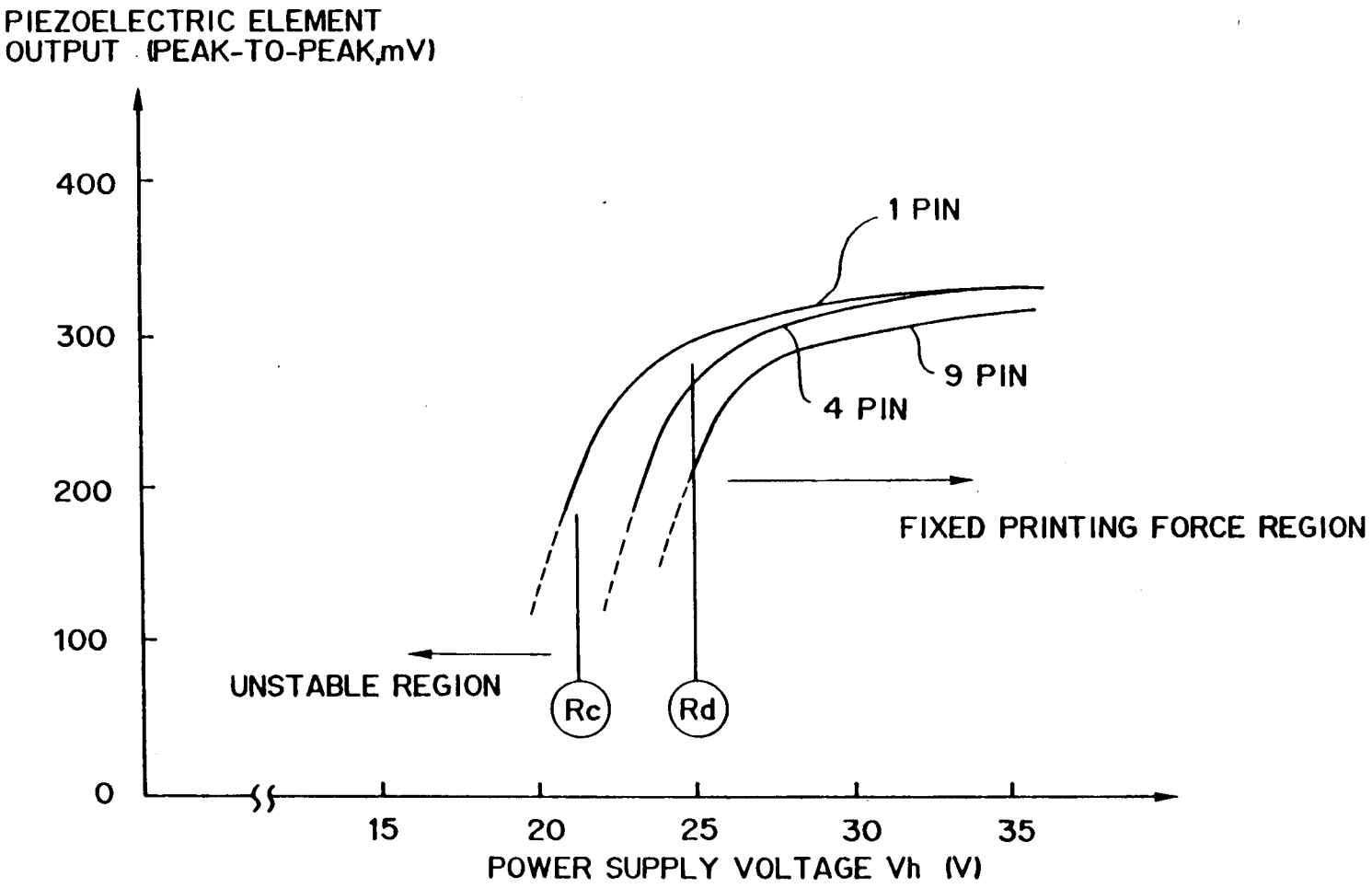
FIG. 21 is a graph illustrating the printing voltage vs. impact force characteristic of a prior-art dot-matrix impact printer.

FIG. 21 shows the printing force vs. applied voltage Vh characteristic of a prior-art wire-dot print head as measured in the same way. In the prior art, printing becomes unstable below approximately 21 V (to the left of the line Rc in FIG. 20), while a substantially constant printing force is obtained above approximately 25 V (to the right of the line Rd in FIG. 20). The intermediate region (between the lines Rc and Rd) in which the printing force can be adjusted by altering the voltage Vh is comparatively narrow, and the rate of change of the printing force in this interval is correspondingly steep. Moreover, printing conditions such as the number of dots to be printed simultaneously i.e., the number of wires (pins) to be driven simultaneously can cause variation in the printing force in the region in which the variation of the printing force is possible. This is in contrast to the situation in the invention in which the printing force is not substantially varied with the number of pins simultaneously driven, and differences between individual heads, difference in the head gap, and other printing conditions. In practice, it is therefore difficult to adjust or modify the printing force in a reliable manner in this interval. The reason is that the driving time of the print wires is determined without relation to the state of motion of the print wires. A consequence of this is that it is extremely difficult to reduce the energy supplied to the wire-dot print head and still maintain the required printing force, due to manufacturing variations in the paper and the wire-dot print head.

In the first and second embodiments, the power supply voltage Vh or the reference voltage G is used as a parameter determining the printing force. Any other parameter determining the printing force can alternatively be used and altered for changing the printing force.

In the embodiments described, the parameter determining the printing force is changed responsive to manipulation of the control panel by the operator. Alternatively, the voltage generated by the sensor circuit 52 can be altered automatically in response to the output of a gap adjustment lever or paper thickness sensor (not shown in the drawings). The invention was described in relation to a spring-release wire-dot print head, but it can also be applied to other types of heads, such as the clapper type and the piezoelectric type.

As has been described, the invention has the combination of the feature that print wires are driven according to the output of sensors that sense their position, and that a parameter determining the printing force is changed, the examples of the parameter being the driving voltage and the reference voltage. Because of the combined features, the printing force can be adjusted in a stable fashion, i.e., with a high reproducibility. In other words, the optimum energy can always be supplied, regardless of variations in factors such as paper thickness, so printing of constant quality can be obtained in an efficient manner, with minimal noise. This enables such new dot-matrix impact printing features as halftone printing with variable dot size and darkness.

What is claimed is:

1. A dot-matrix impact printer comprising:

a wire-dot print head having one or more print wires which extend forward generally parallel with each other and print dots by impact on a printing medium;

sensing means for sensing the position of said print wires and generating signals indicating the position of said print wires, wherein said sensing means comprises:

a plurality of capacitive sensors in association with the respective print wires, the capacitance of each capacitive sensor varying responsive to the position of the associated print wire, wherein each of said capacitive sensors for each print wire comprises:

a fixed electrode attached to a fixed part of the print head; and a movable electrode formed of an armature to which said print wire is attached by a rear end of each print wire being fixed to the associated armature, said movable electrode movable with the print wire so that the distance between said fixed electrode and said movable electrode varies with the motion of the print wire, whereby the capacitance between said fixed electrode and said movable electrode varies with the motion of the print wire;

said print head further comprising:

cores in association with the respective armatures, each core having its forward end adjacent to a rear surface of the associated armature;

coils in association with the respective cores, each coil being wound on the associated core, each of said coils and the associated core forming an electromagnet;

a cylindrical wall surrounding said armatures, said cores and said coils;

an annular permanent magnet forming part of said cylindrical wall;

resilient support members in association with the respective armatures, each resilient support member having a first end fixed at said cylindrical wall and a second end fixed to the associated armature;

a front yoke having protrusions extending radially from said cylindrical wall radially inward, each protrusion being positioned on a side of one of said armatures; and magnetic path means for allowing magnetic flux from said permanent magnet to pass through said cores, said armature and said front yoke;

a substantially disk-shaped rear yoke connecting the permanent magnet and the cores;

a front armature yoke having an annular part forming part of said cylindrical wall and protrusions extending radially inward from said annular part between adjacent armatures;

a sensor card positioned in front of the armatures and having a rear surface on which the fixed electrodes are formed to face the armatures;

a capacitance detection circuit connected to said capacitive sensors for generating electrical signals indicating the capacitances of the capacitive sensors;

means for setting a parameter determining a printing force with which each of said print wires impacts the printing medium; and control and driving means responsive to said signals from said sensing means and said parameter setting means for driving said print wires with a timing determined by said signals wherein said control and driving means causes an electric current to flow through the coils for generating a magnetic flux through the associated core in a direction to cancel the magnetic flux through the associated core from the permanent magnet and, when each of the coils is not energized, the associated armature is attracted toward the associated core to resiliently deform the associated resilient support member, and, when each of the coils is energized, the associated armature is released and moved forward by the action of the associated resilient support member.

2. A dot-matrix impact printer according to claim 1, wherein said print head comprises a plurality of electromagnets in association with the respective print wires, and arranged so that each print wire is driven toward said printing medium when the associated electromagnet is energized; and said control and drive means comprises:

a control circuit for generating a print signal;

a timing circuit for generating an onset detection signal indicating the onset of motion of said print wires and an impact detection signal indicating the moment of their impact with said printing medium; and a drive circuit including:

a first current path means for connecting the electromagnet across a pair of power supply terminals to permit flow of current from the power supply to the electromagnet;

a second current path means for connecting a resistance means across the electromagnet to permit electric current due to any electromotive force induced in the electromagnet to flow through the resistance means;

a third current path means for connecting the electromagnet to said power supply to permit electric current due to an electromotive force induced in the electromagnet to flow to the power supply;

current path control means for causing an electric current to flow through said first current path means to energize said electromagnet upon reception of said print signal, being responsive to said timing circuit for terminating the current flow through said first current path means and initiating the current flow through said second current path means upon reception of said onset detection signal, and for terminating the current flow through said second current path means and initiating the current flow through said third current path means upon reception of said impact detection signal.

3. A dot-matrix impact printer according to claim 2, wherein said print wire is retracted by being attracted by a permanent magnet when the associated electromagnet is deenergized.

4. A dot-matrix impact printer according to claim 2, wherein said current path control means terminates the current flow through said first current path means and initiates the current flow through said second current path means a fixed time after said onset detection signal is produced.

5. A dot-matrix impact printer according to claim 2, further comprising a power supply for energizing said print head, said power supply capable of producing a changeable voltage, wherein said parameter is the voltage of said power supply and said control means changes said voltage of said power supply.

6. A dot-matrix impact printer according to claim 5, wherein said power supply is capable of producing either a first voltage or a second voltage lower than said first voltage in accordance with the set printing force.

7. A dot-matrix impact printer according to claim 2, further comprising:

means responsive to said sensing means for producing a signal indicating the velocity of the printer wire; and a comparator for comparing the velocity signal with a reference signal; wherein said parameter is said reference signal and said control means changes said reference signal.

8. A dot-matrix impact printer according to claim 2, wherein said means for setting the parameter determining the printing force comprises a switch.

9. A dot-matrix impact printer according to claim 7, wherein said means for setting the parameter determining the printing force comprises a switch.

* * * * *